United States Patent [19]

Maier et al.

[11] 4,355,487

[45] Oct. 26, 1982

[54] AIR-POWERED SANDER

[76] Inventors: Peter Maier, Gerokstrasse 1, 7311 Neidlingen/Teck; Dieter Tschacher, Hohenzollernstrasse 4, 7313 Reichenbach, both of Fed. Rep. of Germany

[21] Appl. No.: 229,035

[22] Filed: Jan. 28, 1981

[30] Foreign Application Priority Data

Feb. 2, 1980 [DE] Fed. Rep. of Germany ..... 3003805

[51] Int. Cl.[3] ..... B24B 55/06; B24B 23/00

[52] U.S. Cl. ..... 51/170 MT; 15/387; 51/273

[58] Field of Search ..... 51/170 MT, 170 T, 170 R, 51/170 TL, 273, 177, 174; 15/344, 387

[56] References Cited

U.S. PATENT DOCUMENTS 2,143,970 1/1939 Blood ..... 51/273

3,824,745 7/1974 Hutchins ..... 51/273

FOREIGN PATENT DOCUMENTS 2340801 9/1977 France ..... 51/273

*Primary Examiner*—Roscoe V. Parker

*Attorney, Agent, or Firm*—Blanchard, Flynn, Thiel, Boutell & Tanis

[57] ABSTRACT

An air-powered sander is made up of a housing with a compressed air motor within it and designed for driving a sanding pad. The sander has a system for clearing dust, produced on sanding, from the pad. This system is made up of an impellor wheel freely turning on a motor shaft in the housing. On the two sides of the impellor wheel two groups of blades are present. A nozzle, joined with the airway for supplying the motor with compressed air, is used for directing at least one air jet against one group of the blades on the wheel. The other group of blades, on the other side of the wheel, is designed for producing a dust/air current for clearing sanding dust from the pad. For this purpose a dust take-up space is present extending from the pad to a position near inner ends of the second group of blades on the impellor wheel. There is furthermore a dust output airway extending from outer ends of the blades of the second group to a point at which the dust is forced out of the housing by way of an air current as produced by the impellor wheel.

11 Claims, 4 Drawing Figures

AIR-POWERED SANDER

FIELD OF THE INVENTION

The present invention relates to an air-powered sander with a housing and a compressed air motor placed in the housing. The motor is designed for orbitally moving a pad which is joined to the housing. Because on sanding a workpiece dust is produced, the sander has a dust clearing or aspiration system.

BACKGROUND OF THE INVENTION

In the case of such sanders as presently offered and marketed the dust clearing or aspiration system is not part of the sander in the limited sense of the word and in fact it takes the form of a separate aspiration unit with its own fan. Because it has to be kept joined to such a dust clearing system, the sander may not readily be moved from place to place in view of the connection with the outside dust aspiration system which is so large that it may not be moved along with the sander as it is used for sanding different parts of the work or different workpieces. In fact the dust aspiration system is so great in size that it has to have its own special position in the workshop and is furthermore responsible for increasing the costs of the plant in the first place.

In the case of sanders powered by electricity or compressed air there has been a suggestion to have an impellor wheel, used for aspiration of dust, on the motor shaft, so that no outside aspiration fan is necessary. However there is the shortcoming here that the rate of clearing dust does not take place at the desired rate when a great amount of dust is being produced because then the motor will only be turning at a low speed because of the heavier loading.

SHORT OUTLINE OF THE INVENTION

One purpose of the present invention is that of designing a sander designed for air power operation and having a housing and a compressed air motor within the housing for driving a pad movingly joined to the housing for sanding a workpiece and with a dust clearing system for dust produced on working with the sander, so that the dust clearing system forms a part of the sander and is able to take up the dust at a high aspiration rate when the sanding speed, that is to say the speed at which material is machined from the workpiece, is high.

For effecting this purpose and other purposes the sander of the invention has an impellor wheel freely bearinged in the housing and having first and second groups of blades thereon, an input airway extending to the motor, an air nozzle joined with the input airway for producing a jet blowing against the first group of blades of the wheel, a dust take-up airway extending from a position near the pad to a position near radially inner ends of the second group of blades on the wheel, and a dust output airway extending from radially outer ends of the second group of blades to a point at which the dust may be forced out of said housing when air current is produced by the impellor wheel.

In the case of the sander of the present invention there is no decrease in the rate of clearing dust with an increase in the rate of machining or grinding the workpiece, this being because the speed of the impellor wheel for transporting the dust/air current through the housing is not dependent on the speed of turning of the motor shaft. The impellor wheel being separately powered by using one of its groups of blades, the structure is made very simple and the price of the sander is only increased to a small degree because the air needed for driving the impellor wheel is branched off from the air supply through the motor. If, in comparison with the motor power of the sander, the air supply is of high capacity, the dust aspiration system within the housing of the sander will be run at an unchanging aspiration rate dependent on the air supply pressure. If, on the other hand, the compressed air capacity is limited in comparison with the power of the sander, that is to say, putting it differently, the air supply rate on hand at the sander is likely to be dependent on the speed of the compressed air motor, because of the limited cross-section of a rubber air line for joining the sander with a compressor, or because of the capacity of the compressor itself (which may furthermore have to be used for supplying other tools at the same time), the aspiration system of the present invention will be even better in operation when there is a decrease in the motor speed, because the compressed air take-up rate of the compressed air motor will be increased with an increase in the speed of turning while on the other hand when there is a decrease in the speed of turning more power will be on hand for the aspiration system.

These useful effects are produced not only in the case of compressed air-powered sanders with a turning pad for the sand paper but furthermore with those having an orbitally moved pad.

Useful further developments will be seen in the dependent claims.

In the case of a sander in which the wheel has a radial plate with one blade group on the one side and the other blade group on the other, the two blade groups are kept separate from each other on the two sides of the wheel. Furthermore, in this way, the blades of the wheel may be made of a great radial size, thus stepping up the dust clearing or dust aspiration effect without the overall size of the wheel being greatly stepped up. The wheel may for this reason be readily housed in normal casings of compressed air-powered sanders.

As a further measure of the invention the wheel may be supported freely on a power output shaft of the motor, this decreasing the amount of space taken up by the wheel and furthermore making the mechanical design simpler.

As part of a still further development of the invention, the bearing for the impellor wheel on the motor power output shaft is placed in the same plane as the first group of blades on the top side of the wheel, such a design decreasing the overall size of the unit formed by the compressed air motor and the impellor wheel, the driving blades or first group of blades on the impellor wheel and the bearing on the motor shaft being axially in line.

An account will now be given of one working example of the invention using the figures.

DETAILED DESCRIPTION

Figure 1:
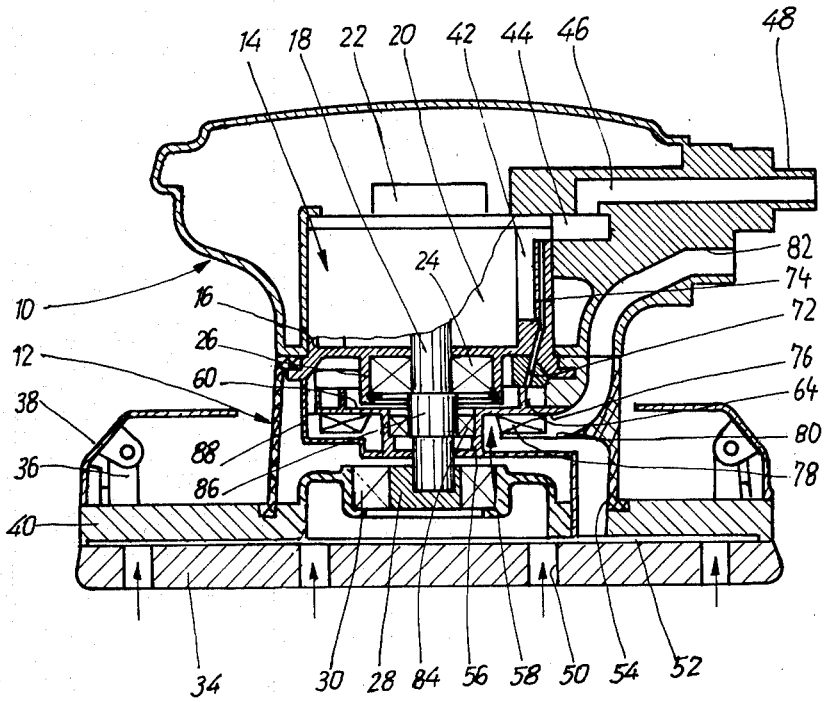
FIG. 1 is a lengthways section through an orbital sander powered by a compressed air motor and having a dust clearing or dust aspiration system with an impellor within its housing.
Figure 2:
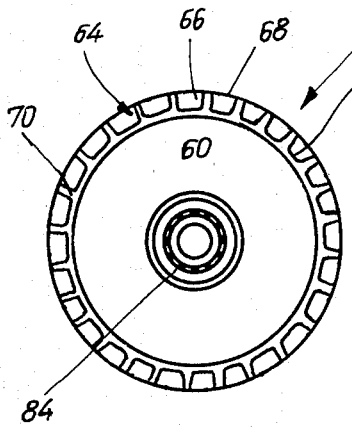
FIG. 2 is an axial view of the top side of the impellor wheel of the dust clearing blower of the orbital sander to be seen in FIG. 1.
Figure 4:
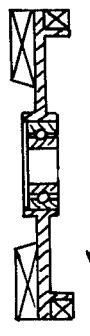
FIG. 4 is a side view of the structure of FIGS. 2 and 3.
Figure 3:
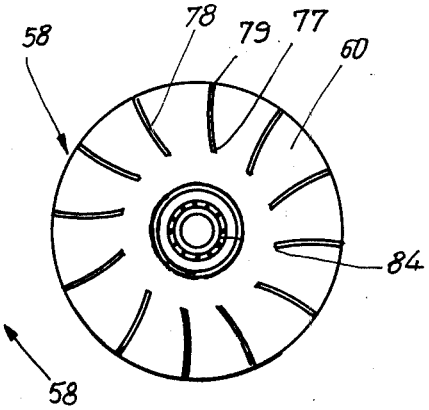
FIG. 3 is an axial view looking towards the blower blade side of the impellor wheel of the orbital sander of FIG. 1.

As will be seen in FIG. 1, a compressed air-powered orbital sander has a housing made up of a top housing part 10 and a lower housing part 12, which are both made of molded synthetic resin and may, for their part, be made up of a number of separate parts. A compressed air-powered vane motor 14 is fixed in position between the two housing parts 10 and 12. Motor 14 has a motor housing 16, a motor shaft 18 and vanes 20 on shaft 18. The parts joining the two housing parts 10 and 12 are not detailed in the figure.

The top end of motor shaft 18 is supported in a bearing 22 on motor housing 16. A lower bearing 24 for the motor shaft is supported in a cylindrical casing 26 extending downwardly and forming part of the bottom of the motor housing.

On the free lower end of motor shaft 18 an eccentric 28 is keyed, the eccentric being taken up in a further bearing 30 for driving backing plate 40 to which sanding pad 34 is fixed. Sand paper may be fixed in a normal way to pad 34 by way of spring levers 36 and 38. Backing plate 40 is joined by way of an elastic skirt, forming part of lower housing part 12, for stopping its turning in relation to the housing.

An air inlet header 42 of the vane motor 14 is joined up by way of a space 44 and inlet airway 46 within the top housing part 10 with a male air connection 48, over which the end of a piece of rubber air line may be slipped.

For clearing dust produced on sanding from the workpiece pad 34 has air inlet openings 50 whose top ends are joined with a low header space formed at the lower side of backing plate 40. Header space 52 is joined with at least one dust take-up airway 54 extending firstly in a generally upright direction from the header space 52 and then sideways towards the motor shaft 18, from which it goes into a generally ring-like space within the blades of an impellor wheel 58, the lower wall of the dust take-up airway 54 being in line with the lower edge of the ring-like space 56. The direction and geometry of the dust take-up airway may be changed to be in line with the design of the rest of the structure.

The impellor wheel 58 has a radial plate 60 joined with the top part of the ring-like space 56. On the top side of plate 60 there is a collar 62 having a square cross-section. Within collar 62 pockets 64 are formed which are open towards the outer edge and in an upward direction. As seen axially, these pockets 64 are square in cross-section, although they may take the form of sectors of circles if desired, the limiting faces 66 of the pockets having generatrices parallel to the axis of turning of impellor wheel 58. By way of an inwardly curved part-spherical face 68 the pockets 64 are joined with the edge of the impellor wheel. The walls between the pockets 64 take the form of the driving blades 70 of the impellor wheel 58.

As may be seen from FIG. 1, over the group of driving blades 70 at least one nozzle block 72 is placed joined by way of branch airway 74 in the motor housing 16 with the motor's air supply. Radially outside the ring of driving blades 70 there is, in the same axial plane as the nozzle blocks 72, an outlet airway 76.

On the lower side of plate 60 of the impellor wheel there are blower blades 78 extending away from the ring-like space 56. These blades, which extend as far as the edge of the wheel, may be spiral or straight or each blade may be part-spiral and part-straight so as to extend from a middle point 77 of the impellor wheel as far as its edge 79. The innermost ends of the blower blades 78 are axially in line with the end of the dust take-up airway 54. Their outer ends are radially in line with the ends of a dust output airway 80, having the outlet airway 76 opening into it and which is furthermore formed in the top housing part 10 and comes to an end at a connection opening 82 which may be joined up with a rubber pipe going to a dust take-up bag, not figured.

The impellor wheel 58 is at its ring-like space 56 joined by way of a ball bearing 84 on a part 86 (under the bearing 24) of the motor shaft 18 so that impellor wheel 58 may be freely turned and so that the part 60 is right under the free edge of the cylindrical casing 26 of the motor housing 16 and so that the collar 62 with the pockets 64 is placed around the lower bearing 24 of motor shaft 18. The lower side of the impellor wheel 58 is covered by a casing 88 forming the outer part of the blower system whose inner part is formed by the impellor wheel.

Account of operation of working example

As soon as compressed air is let into the male air connection 48 the impellor wheel 58, taking the form of a single casting or molding, is run up to a speed dependent on the compressed air supply pressure and the choke effect in the branch airway 74 without, be it noted, however being dependent on the speed of the motor shaft. The air jet from nozzle block 72 is at an angle to the driving blades 70 and is changed in direction by the pockets between the blades 70 so that the jet will come out of the pockets in a generally radial direction and be taken up in the outlet airway 76, from which point this air, which has been used for driving the impellor wheel 58, will be taken up in the output airway 80, it then helping in driving the dust along into the dust bag. However, if desired it will clearly be possible for the outlet airway 76 to come to an end at the side of the housing for opening directly into the atmosphere.

It will be seen that because of this design the impellor wheel 58 is then turned at a high speed even though the pad 34 is braked by being strongly forced against the work so that the motor shaft is slowed down. For this reason the impellor wheel 58 is specially able to make certain that under such working conditions, in which most dust is produced, the dust is safely and certainly taken up and aspirated as it comes from the work.

The embodiments of the invention in which an exclusive property or privilege is claimed are defined as follows:

1. In an air-powered sander with a housing, with a compressed air motor within said housing, with a pad movingly joined to said housing and designed to be moved by said motor for sanding a workpiece, and with a dust clearing system for dust produced on working with said sander, the improvement comprising wherein said sander further has an impellor wheel freely turningly bearinged in said housing and having first and second groups of blades thereon, a structure of said housing enclosing an input airway to said motor, a further structure of said housing forming an air nozzle joined with said input airway and designed for producing an air jet blowing against said first group of blades, a further structure of said housing forming a dust take-up airway extending from a position near said pad to a position near radially inner ends of said second group of blades on said wheel, and forming a dust output airway extending from radially outer ends of said second group blades to a point at which said dust may be forced out of said housing in an air current as produced by said impellor wheel.

2. The invention as claimed in claim 1 wherein said wheel has a radial plate with one blade group on the one side thereof and the other blade group on the other.

3. The invention as claimed in claim 2 wherein the first group of blades are in the form of walls between hollows in a collar extending axially from the edge part of said wheel radial plate, said hollows being in the form of pockets.

4. The invention as claimed in claim 3 wherein said pockets have a part-cylindrical limiting wall whose axis is parallel to the axis of rotation of said wheel, said limiting wall having an inwardly curving face between it and further faces of said wheel.

5. The invention as claimed in anyone of claims 1 to 3 having a motor shaft designed to be turned by said air-powered motor, said impellor wheel being turningly bearinged on said shaft.

6. The invention as claimed in claim 4 having a motor shaft designed to be turned by said air-power motor and a bearing supporting said shaft in said housing, said pockets and said bearing being generally in a common radial plane, said pockets furthermore being radially outside said bearing.

7. The invention as claimed in anyone of claims 3 to 6 wherein the second group blades extend from a middle position of said wheel to the edge thereof.

8. The invention as claimed in claim 7 wherein said second group blades are spirally curved in a radial plane.

9. The invention as claimed in claim 7 wherein said second blades are straight.

10. The invention as claimed in claim 7 wherein each blade of said second group blades is in part straight and in part curved.

11. The invention as claimed in claim 7 having a structure joining said pad with said housing for backward and forward motion and a pad driving eccentric on said motor shaft, a structure enclosing a dust/air header space between said pad and the lower face of said housing, said header space being joined with said dust take-up airway, said pad having air inlet openings therethrough.

* * * * *